US012704131B2

(12) United States Patent
Ortiz Santini et al.

(10) Patent No.: US 12,704,131 B2
(45) Date of Patent: Aug. 11, 2026

(54) COMFORT FAN PROVIDING CONTINUOUS RADIAL AIR FLOW

(71) Applicant: Whiskey Lima Corporation, Pompano Beach, FL (US)

(72) Inventors: Lionel Valentin Ortiz Santini, Pompano Beach, FL (US); Nelson Juan Ortiz Santini, Columbia, MD (US); Arnaldo Santini Green, Coto Laurel, PR (US); Wendy Diane Ortiz, Pompano Beach, FL (US)

(73) Assignee: Whiskey Lima Corporation, Pompano Beach, FL (US)

( * ) Notice: Subject to any disclaimer, the term of this patent is extended or adjusted under 35 U.S.C. 154(b) by 0 days.

(21) Appl. No.: 19/316,088

(22) Filed: Sep. 2, 2025

(65) Prior Publication Data

US 2026/0028996 A1 Jan. 29, 2026

Related U.S. Application Data

(63) Continuation of application No. 19/066,509, filed on Feb. 28, 2025, now Pat. No. 12,404,874.

(60) Provisional application No. 63/561,082, filed on Mar. 4, 2024.

(51) Int. Cl.
*F04D 29/54* (2006.01)

(52) U.S. Cl.
CPC ..... *F04D 29/547* (2013.01)

(58) Field of Classification Search
CPC ..... F04D 29/545
See application file for complete search history.

(56) References Cited

U.S. PATENT DOCUMENTS

| | | | |
|---|---|---|---|
| 2,159,189 | A | 5/1939 | Wais |
| 5,449,275 | A | 9/1995 | Gluszek et al. |
| 7,648,339 | B1 | 1/2010 | Ediger et al. |
| 8,864,447 | B1 | 10/2014 | Humphrey |
| 9,952,636 | B2 | 4/2018 | Montero et al. |
| 11,384,948 | B2 | 7/2022 | Desmet et al. |
| 2006/0199515 | A1 | 9/2006 | Lasko et al. |
| 2017/0087500 | A1 | 3/2017 | Combs et al. |
| 2017/0205105 | A1 | 7/2017 | Adam et al. |
| 2020/0332701 | A1 | 10/2020 | Park et al. |
| 2021/0088519 | A1 | 3/2021 | Link et al. |
| 2022/0290690 | A1 | 9/2022 | Spaulding et al. |

(Continued)

FOREIGN PATENT DOCUMENTS

| | | |
|---|---|---|
| CN | 202926663 | 5/2013 |
| CN | 207185713 | 4/2018 |
| CN | 211174695 | 8/2020 |

(Continued)

OTHER PUBLICATIONS

International Search Report and Written Opinion for PCT/US2025/018271, International Filing Date Mar. 4, 2025, Mailing Date May 7, 2025, Authorized Officer Taina Matos, pp. 1-9.

*Primary Examiner* — Brian O Peters
(74) *Attorney, Agent, or Firm* — The Concept Law Group, PA; Scott D. Smiley; Scott M. Garrett

(57) ABSTRACT

A fan device provides airflow throughout a radial region from the location of the fan so that people positioned around the fan simultaneously receive a continuous flow of air at a calculated velocity that provides a desired cooling or heating effect and thermal comfort, and that can be further adjusted by the operator/user.

16 Claims, 14 Drawing Sheets

(56) References Cited

U.S. PATENT DOCUMENTS

2022/0390581 A1 12/2022 Steiner

FOREIGN PATENT DOCUMENTS

| | | |
|---|---|---|
| GB | 2582796 | 10/2020 |
| KR | 200349647 | 5/2004 |
| KR | 20160049796 | 5/2016 |

500

PRIOR ART

COMFORT FAN PROVIDING CONTINUOUS RADIAL AIR FLOW

CROSS-REFERENCE TO RELATED APPLICATION

This application is a continuation of U.S. patent application Ser. No. 19/066,509, filed Feb. 28, 2025, and issued as U.S. Pat. No. 12,404,874, granted Sep. 2, 2025, and through that application claims priority to U.S. Provisional Patent Application No. 63/561,082 filed Mar. 4, 2024, the entirety of which is incorporated by reference.

FIELD OF THE INVENTION

The present invention relates generally to fan devices for providing an air flow for comfort, either for cooling or heating, and, more particularly, relates to a stationary, variable speed, electrically powered, comfort-cooling and heating fan that provides a continuous radial air flow to provide thermal comfort.

BACKGROUND OF THE INVENTION

People live is wide range of climates which can range from extremes of hot and cold. Of course, in extreme environments, humans need substantial heating or cooling machinery to be comfortable. This can involve actively heating or cooling circulating air within a structure. In more moderate climate conditions, however, the simple use of a fan, or a fan with a heat source, can provide sufficient comfort. However, fans tend to be either fixed, such as ceiling fans, or portable. Portable fan devices blow air in one direction, providing comfort only for those in the path of the air blowing from the fan. To improve the distribution of air blown by a fan, oscillating mechanisms were developed so that a fan will automatically oscillate in a range of directions. This provides a moment of comfort as the fan oscillates past a given location. Once it passes that location, however, no more air is blown in that direction from the fan until the fan reverses direction and again passes by location.

It is not uncommon for people to share a table, and sit around the table. If an air flow is desired to provide comfort to such a group of people, then an oscillating fan is not an ideal solution. If the oscillating fan is placed to the side of the table, then some people will be closer to the fan than others, and those closest to the fan, as well as those farthest from the fan may receive too much, or too little air flow. If an oscillating fan is placed in the middle, then again, each person will only get a brief flow of air as the fan oscillates between angles.

Therefore, a need exists to overcome the problems with the prior art as discussed above.

SUMMARY OF THE INVENTION

The invention provides a comfort fan or fan device that overcomes the hereinafore-mentioned disadvantages of the heretofore-known devices and methods of this general type and that generates a radial, continuous airflow around the circumference of the comfort fan, or a substantial portion of the circumference of the comfort fan. The rate of the air flow out of the comfort fan is selected so that the incident air flow velocity on a person within a given distance from the comfort fan, will experience a desired relief from the ambient environmental conditions. This can be either a cooling or a warming effect. The initial air flow rate can be based on industry standards that describe the comfort effect of air flow for most people.

In accordance with the inventive embodiments described herein, there is provided a fan device that includes a housing having a columnar shape and defining a central vertical axis. The housing includes an inlet configured to allow air into the housing, and an outlet formed around a circumference of the housing. There is a fan positioned inside the housing between the inlet and the outlet, and it is configured to blow air toward the outlet. There is a directional ducting member positioned inside the housing, between the fan and the outlet, to direct air blown by the fan through the outlet, radially, around the circumference of the housing. The air flow in all directions is continuous. The outlet is formed as a gap between the housing and the directional ducting member at the top of the housing.

In accordance with a further feature, the housing has a circular hyperboloid shape.

In accordance with a further feature, wherein the directional ducting member has a circular hyperboloid shape, and wherein a distance between an inside of the housing and the directional ducting member decreases between the fan and the outlet.

In accordance with a further feature, the inlet is positioned above a base of the fan device, and the outlet is positioned at a top of the comfort fan.

In accordance with a further feature, the outlet is configured to direct air at an angle of between five and fifteen degrees relative to horizontal.

In accordance with a further feature, the fan is oriented to blow air in a vertical direction.

In accordance with a further feature, there is further included a control which is operable to adjust an air flow rate by controlling a speed of the fan.

In accordance with a further feature, the control includes a manual control provided on the fan device.

In accordance with a further feature, the control further includes a wireless transceiver operable to receive control information that indicates a speed of the fan to control the air flow rate.

In accordance with a further feature, there is further provided a temperature sensor, wherein an ambient temperature indicated by the temperature sensor is used, at least in part, by the fan device to set an initial air flow rate out of the outlet.

In accordance with a further feature, there is further included a humidity sensor, and wherein an ambient relative humidity indicated by the humidity sensor is further used by the fan device to set an initial air flow rate out of the outlet.

In accordance with a further feature, there is further included a light element that can be selectively illuminated to provide light outward from the fan device.

In accordance with the inventive embodiments described herein, there is provided a comfort fan that includes a housing having a vertical axis, an air inlet and an air outlet. The air outlet is configured to direct air out of the housing, radially to the vertical axis, around a three hundred sixty-degree circumference of the comfort fan, continuously. There are fan blades of a fan positioned inside the housing between the air inlet and the air outlet. The continuous radial airflow is accomplished without any oscillation of the comfort fan, and only the fan blades inside the comfort fan move; there are no other moving parts. There is a motor coupled to the fan blades to drive the fan blades at a selected speed. There is also a directional ducting member, having a circular hyperboloid shape, positioned inside the housing between the fan blades and the air outlet. The directional ducting member directs air blown by the fan blades through the air outlet radially outward, generally perpendicular to the vertical axis. A distance between the directional ducting member and the housing, inside the comfort fan, decreases from a lower terminus of the directional ducting member and the air outlet.

In accordance with a further feature, the air outlet is configured to direct air out of the housing radially entirely around the vertical axis, throughout an angle of three hundred sixty degrees.

In accordance with a further feature, the air outlet is positioned above the air inlet.

In accordance with a further feature, the air outlet is positioned at a height of eight to fifteen inches above a bottom of the comfort fan.

In accordance with a further feature, the motor is operated to provide an air flow rate of 160 to 400 feet minute at a selected distance from the comfort fan.

In accordance with a further feature, there is further included a temperature sensor, wherein an ambient temperature indicated by the temperature sensor is used, at least in part, to set an initial air flow rate out of the air outlet.

In accordance with a further feature, there is further included a humidity sensor, and wherein an ambient relative humidity indicated by the humidity sensor is further used by the comfort fan to set an initial air flow rate out of the outlet.

In accordance with a further feature, there is further included a light element that can be selectively illuminated to provide light outward from the comfort fan.

Although the invention is illustrated and described herein as embodied in a comfort fan device that provide continuous radial air flow, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The term "radius" as used herein is defined as the distance from a locus or point to a position on a curve around that locus. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. The terms "vertical" and "horizontal" have their ordinary meaning; vertical is in a direction parallel to the gravitational vector, and horizontal is at a right angle to vertical. When used to describe components or structural elements of the inventive embodiments it shall be assumed that the device, machine, or system is oriented as intended for use as described herein. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the article being referenced. The terms "program," "software application," and the like as used herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequence of instructions designed for execution on a computer system. Those skilled in the art can understand the specific meanings of the above-mentioned terms in the embodiments of the present invention according to the specific circumstances.

As used herein, the term "hyperboloid" refers to a geometric shape, sometimes called a hyperboloid of revolution or a circular hyperboloid, that is formed by rotating a hyperbola around an axis. Generally, herein, the axis will be a vertical axis unless otherwise stated. The hyperboloid is the surface obtained from a hyperboloid of revolution by deforming it by means of directional scalings, or more generally, of an affine transformation.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 11A:
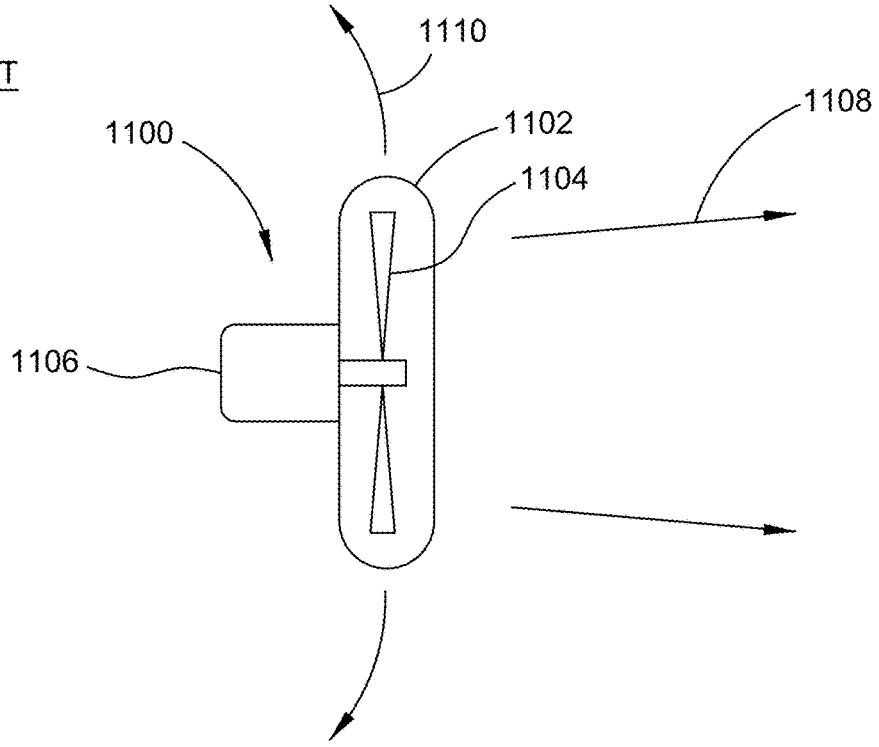
FIG.11A PRIOR ART
FIG. 11A shows an overhead view of a prior art oscillating fan.
Figure 11B:
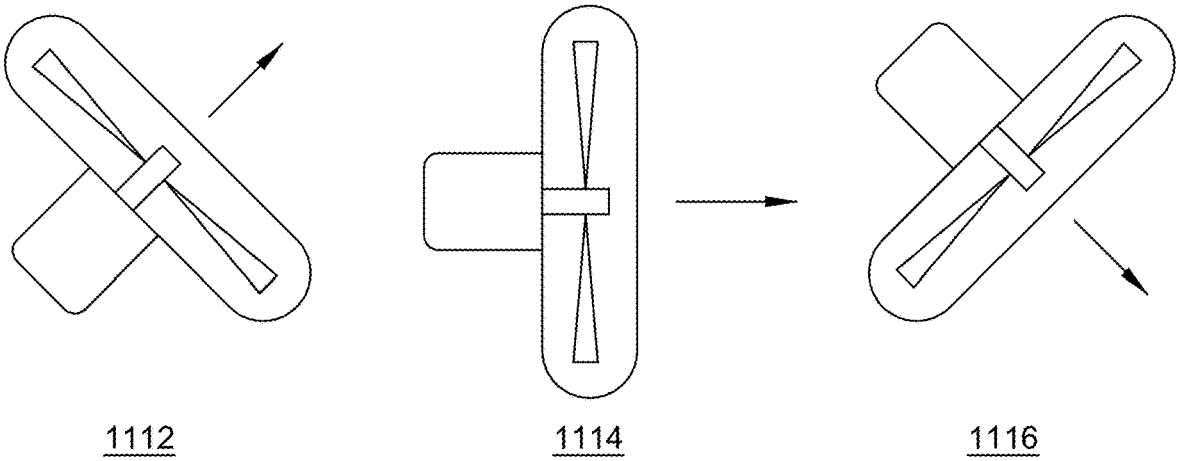
FIG. 11B shows overhead views of a prior art oscillating fan throughout its range of movement.

FIG. 11A shows an overhead view of a prior art oscillating fan 1100, which includes a cage 1102 in which a set of fan blades 1104 with multiple blades is located. The cage 1102 prevents inadvertent contact with the spinning fan blades 1104 during operation of the fan 1100. The fan blades 1104 are driven by a motor 1106. The motor 1106 is mounted on a column or other support that is attached, at its lower end, to a base that rests on the floor or other surface. The main portions of the fan 1100, including the cage 1102, blades 1104, and motor, oscillate around the support as driven by the motor 1106 through a gear or cam structure, as indicated by arrows 1110, as is well known. The blades are oriented to blow air generally in a horizontal direction, as indicated by arrow 1108, when the fan 1100 is placed on a horizontal surface. If the fan 1100 does not oscillate, then the main air flow from the fan 1100 is experienced only in a narrow angle directly in front of the fan. Of course, in an enclosed room, air throughout the room will be moved, but in, for example, an outdoor environment, if the fan 1100 is not oscillating, a person would have to be directly in front of the fan 1100 to receive air flow. FIG. 11B shows what happens when the fan 1100 is set to oscillate. In general, the fan 1100 can oscillate throughout a range of motion, from a first end position 1112 to a second end position 1116, passing through all positions, including middle position 1114 throughout each oscillation cycle. While this allows a broader range of air flow, the air flow at any given fixed position in the range of oscillator will be only momentary as the fan oscillates continuously. Prior art oscillating fans only oscillate through a range that is typically not more than about one hundred twenty degrees. Thus, to provide airflow to several people, for example, around a table, the fan would have to be moved away from the table so that all people at the table are within the oscillation range of the fan. But then, some people will be closer to the oscillating fan and others further away from the oscillating fan, and as a result, they will experience not only monetary air flow, but substantially different rates of air flow. In an indoor environment, a ceiling fan can be mounted over a seating area, but in an outdoor environment, there is no ceiling to which a ceiling fan can be mounted. Thus, a solution to providing a comforting air flow to people around an area like a table is needed.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient comfort fan that provides a continuous radial air flow at a calculated velocity that is selected to provide a cooling/heating effect and thermal satisfaction based on ambient conditions and personal factors such as metabolic rate and clothing insulation level. The comfort fan draws air in and directs it outward, in a radial manner, at a velocity which is selected such that at the distance a person is located from the fan outlet, the incident air flow will provide an optimal cooling or warming effect. The flow rate can be adjusted to personal preference, but is initially based in a range of air velocity between that which is considered to be minimally effective (160 feet per minute) and a velocity considered to be a nuisance (more than 400 feet per minute). The radial out-flow of air is provided from an elevated position above a surface, such as a table, to avoid blowing air over items on the surface, such as, for example, food items, and the radial air flow can be aimed slightly upwards so that the air flow is incident on people around the fan at about the chest, neck, and face level. The comfort fan avoids the intermittency problem of oscillating fans by providing a continuous air flow radially from the fan, and is ideal for setting up in the center of a table in a warm setting (e.g. outdoors) and providing a gentle cooling air flow to all those seated around the table. Embodiments of the invention provide for warming air flows as well by including a heating element inside the comfort fan. In addition, the comfort fan can include lighting elements to provide lighting for mood as well as task lighting, as desired.

Figure 1:
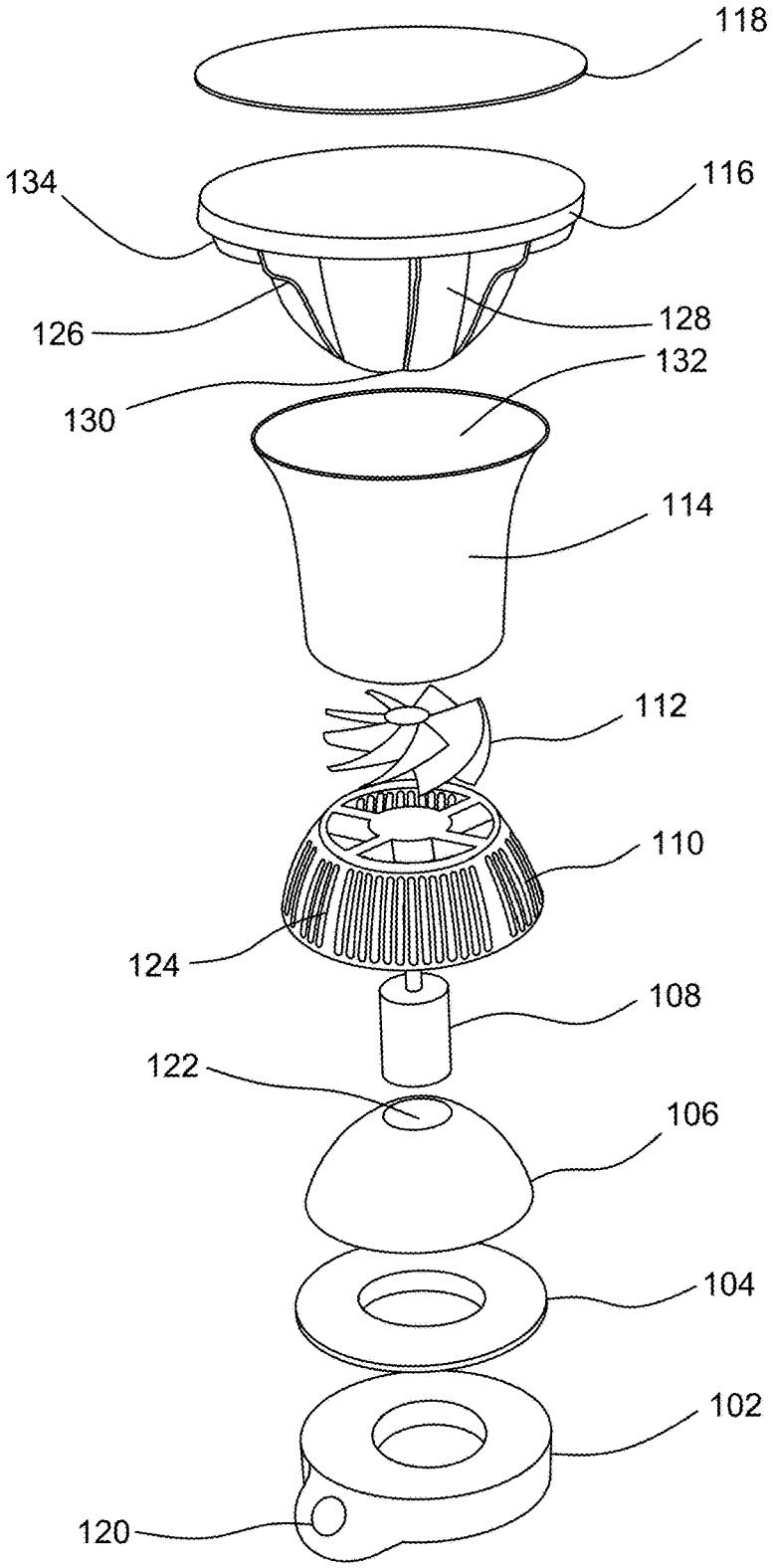
FIG. 1 is an exploded perspective view of a comfort fan that provides continuous radial air flow, in accordance with some embodiments.
Figure 2:
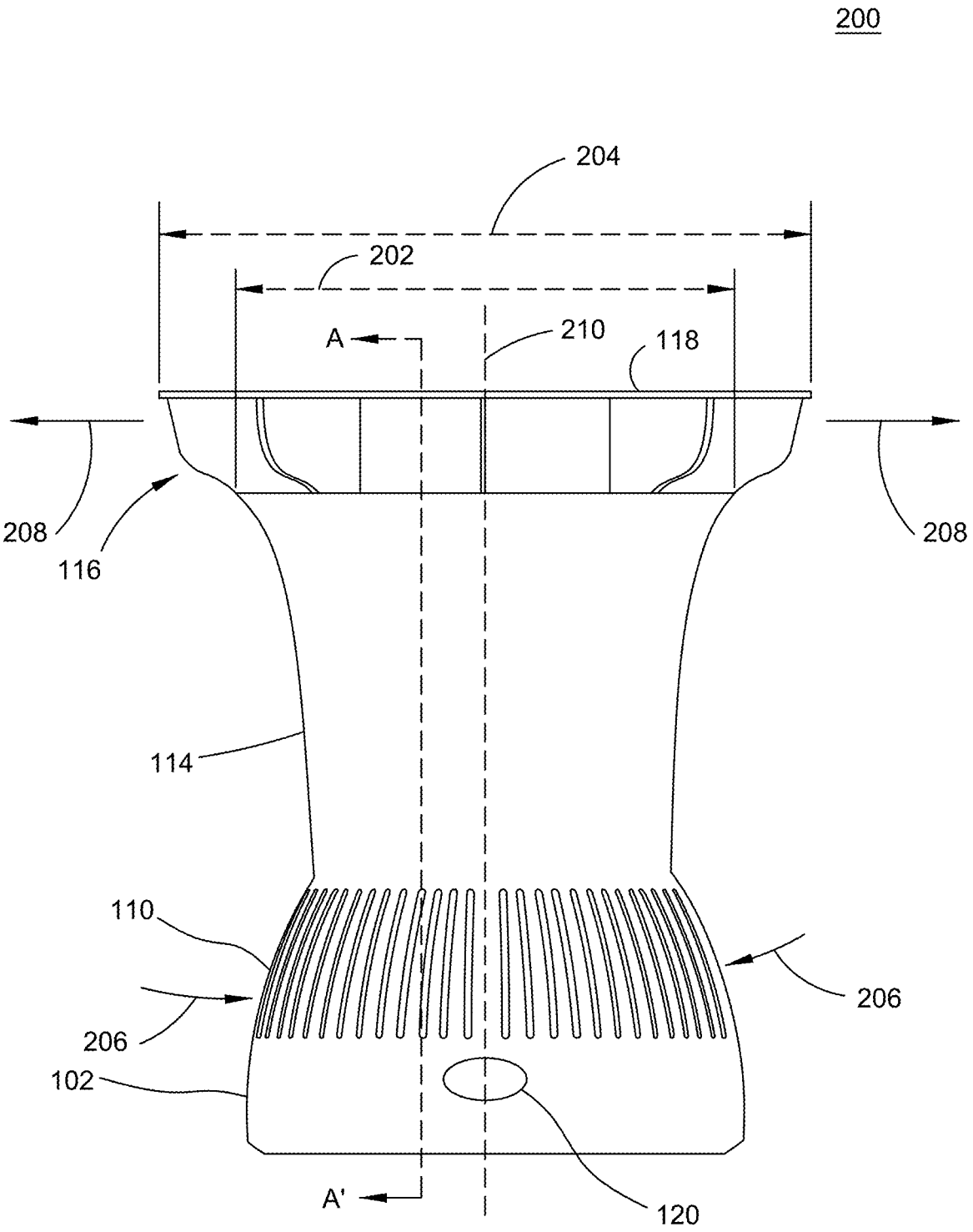
FIG. 2 is a side elevational view of a comfort fan that provides continuous radial air flow, in accordance with some embodiments.

FIG. 1 is an exploded perspective view of a comfort fan 100 that provides continuous radial air flow, in accordance with some embodiments. FIG. 2 shows a side elevational view of the comfort fan 100, and reference should be made to both drawings. The comfort fan 100 in general has a generally columnar shape with a central vertical axis 210, and draws in ambient air through an inlet section 110, as indicated by arrow 206, and blows the air out through an outlet formed between the top of an upper housing section 114. It will be appreciated by those skilled in the art that the precise shape of the fan, and specifically the housing section 114, while being generally columnar, can vary. This means, for example, that the housing may not have a uniform horizontal diameter along its height and may follow any of a variety of curves or shapes. In some embodiments, the housing section 114 can have a circular hyperboloid shape in which the top flares outward and the side, in the vertical direction, follows a hyperbolic or inverted parabolic curve.

The air blown by the comfort fan 100 is directed, at least in part, by a directional ducting member, such as a conic director 116. The conic director 116 can have a variety of shapes, including straight or linear conic, circular hyperboloid, or any other shape in which the horizontal diameter increases along its vertical axis from bottom to top. The outlet air flow is represented by arrow 208, and exits the fan 100 radially around the fan. Said another way, the outlet is formed radially around the fan 100 to generally direct air outward in a horizontal direction, around a substantial angle around the fan 100. In the present example, the fan 100 provides air flow around the entire fan 100, meaning an angle of three hundred sixty degrees. The air flow speed can be moderated or adjusted so that the air flow incident on people who are a distance from the fan 100 is at an optimal rate to provide a desired comfort effect.

Thus, as used herein, it should be understood that the term "radial" in reference to air flow from the comfort fan 100 means continuous air flow in a substantial angle around the fan 100. In some embodiments the radial air flow is circumferential, meaning that air is blown out from the comfort fan around the entire circumference of the comfort fan. The outlet is a circular outlet around, or at least partially around, a central vertical axis 210 defined by the comfort fan 100. Being columnar, the comfort fan 100 is taller (vertical direction) that it is wide (horizontal direction), and, as described, can have a variety of shapes. The comfort fan produces a continuous outward air flow through the entire angle of the circular outlet, and as a result, any persons around the comfort fan will receive a continuous flow of air, even people positioned on opposite sides of the comfort fan from each other. This eliminates the effect of an oscillating fan, which only blows air in a given direction periodically and momentarily. It is contemplated that the circular outlet can be less than a complete circle, and instead follow a circular path around the fan that is less than a full circle. This can allow, for example, a comfort fan that is intended to be placed against a wall, on a table surface, and provide an outflow of air around an angle of one hundred eighty degrees instead of a complete circle around the fan, since blowing air into the wall would be inefficient.

The fan 100 includes a base 102 that can house some or all of the control electronics, a battery, and other components. In some embodiments the base 102 can be removable to allow recharging of the battery without having to move the entire fan 100. In that way bases or batteries can be easily swapped out as one battery becomes depleted of charge and needs to be recharged. A lower separator 104 separates the base 102 from the air inlet chamber, preventing any dust or other particular material from accumulating in the base 102. A parabolic air director 106 can sit on top of the separator 104, inside of the housing inlet section 110. The housing inlet section 110 comprises openings 124 (e.g. slits or slots) though which air is drawn into the fan 100. The air director 106 can be open at the top/middle to accommodate a motor 108 that drives fan blades 112. The motor 108 is oriented so that its drive shaft is vertical. In some embodiments, however, the fan blades 112 can be rim-driven by a shaftless motor. The fan blades 112 are turned at a selected rate to provide the continuous radial air flow at a rate that provides the desired cooling/heating effect and thermal comfort. The air director 106 helps provide a laminar flow of air to the fan blades 112 in a manner that reduces the sound generated by the fan blades 112 that would otherwise occur without the air director 106 being present and instead having a fully open volume below the fan blades 112. The lower end of the upper housing section 114 surrounds the fan blades 112, leaving only a small gap between the inner surface of the upper housing section 114 and the fan blades 112 to optimize the efficiency of moving air from the inlet section 110 into the upper housing section 114. A generally funnel-shaped conic director 116 sits in the upper housing section 114, and has a lower apex 130 that sits directly over the center of the fan blades 112. There can be a plurality of rib walls or vanes 126 that extend from the surface 128 of the conic director 116 that bear against the inner surface 132 of the upper housing section 116, resulting in a space between the surface 128 of the conic director 116 and the inner surface 132 of the upper housing section 114 through which air flows from the fan blades 112. In other embodiments, posts can be used to reduce turbulence that may result from vanes 126. The conic director 116 can have any of a variety of shapes that are generally conic, including paraboloid and hyperboloid shapes. In general, the lower terminus 130 of the conic director 116 has a minimal diameter, and the diameter of the conic director increases with height between the lower terminus 130 and where the surface 128 meets the flange 134. The top flange 134 at the top of the conic director 116 extends outward in the horizontal direction, blocking air flow in the vertical direction and directing air flow in the horizontal direction as indicated by arrow 208. A cap 118 can fit over the top of the conic director 116. To further help direct air in the horizontal direction, the diameter 202 of the top of the upper housing section 114 can be smaller than the diameter 204 of the flange 134. In some embodiments the diameter 204 can be about 20% larger than diameter 202. The fan blades 112 move air upwards, in the present exemplary configuration, into the volume surrounded by the upper housing section 114, and between the conic director 116 and the upper housing section 114, forcing the air outward, radially, around the fan 100, in a continuous air flow. In some embodiments the fan 100 can have a motor speed control 120 the allows a user to adjust the speed of the motor 108/fan blades 112 to adjust the rate of air flow that is incident on the user. As shown here, inlet section 110 directs the air in horizontally, which is then turned vertically. In some embodiments, however, the air flow into the comfort fan 100 can be entirely vertical, which can improve flow velocity in some embodiments.

Figure 3:
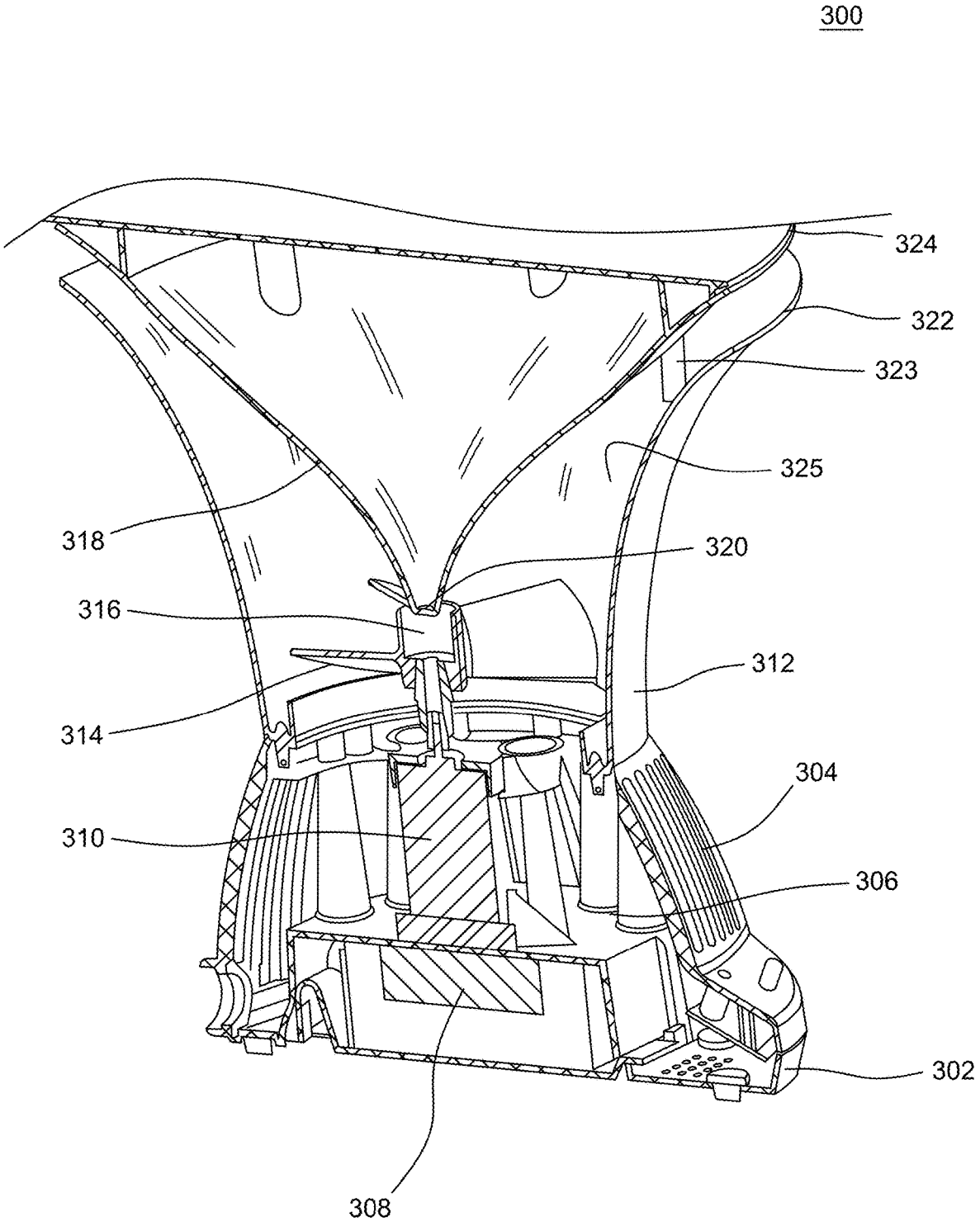
FIG. 3 is a perspective cut-away view of a comfort fan that provides a continuous radial air flow, showing the internal components of the comfort fan, in accordance with some embodiments.
Figure 4:
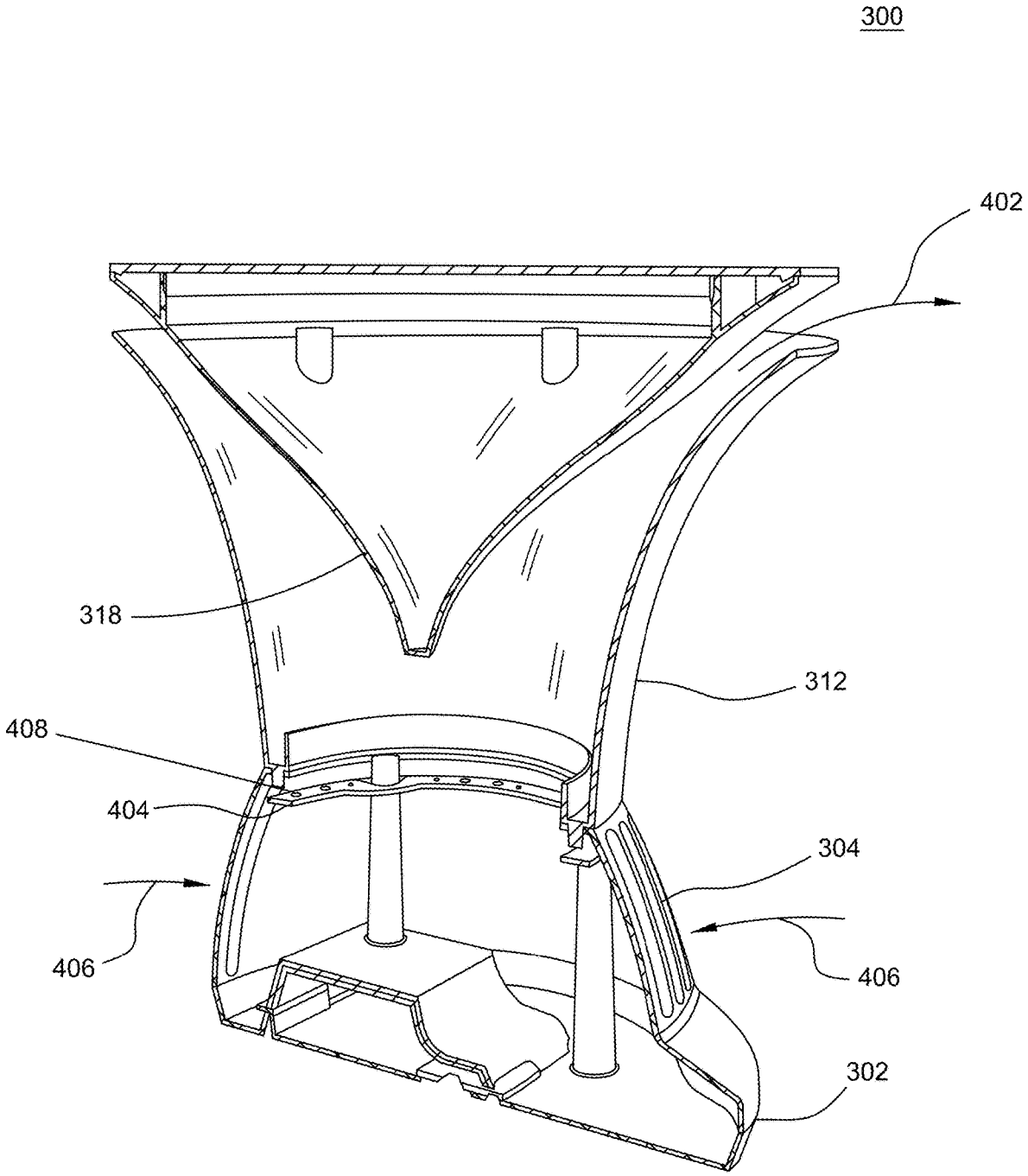
FIG. 4 is a perspective cut-away view of a comfort fan that provides a continuous radial air flow, with most of the internal components of the comfort fan removed to show the internal air volume, in accordance with some embodiments.

FIG. 3 is a perspective cut-away view of a comfort fan 300 that provides a continuous radial air flow, showing the internal components of the comfort fan, in accordance with some embodiments. FIG. 4 show the same view as FIG. 3 but with some of the internal components of the comfort fan 300 removed to show the internal air volume. The comfort fan 300 exemplifies another configuration of a comfort fan that provides a continuous radial air flow. A base section 302 provides the bottom of the housing and can hold a battery 308 and electronic/electrical elements for controlling operation of the comfort fan 300. An inlet section 304 of the housing surrounds a lower internal volume 306, and provides openings, such as slots or apertures through which air can be drawn into the lower internal volume 306. A motor 310 can be vertically oriented in the center of the housing to drive fan blades 314 positioned in the lower end of the upper housing section 312. The fan blades 314 can include a central cylindrical opening 316 into which the lower terminus 320 of the conic director 318 can sit such that the top of the blades of the fan blades 314 at about even with (vertically), or higher than the lower terminus 320. The conic director 318 in this example has a hyperboloid shape, which can be considered a circular hyperboloid air duct, up to a top edge 324 that is about horizontally coextensive with the upper lip 322 of the upper housing section 312. As a result, air blown by the fan blades 314 exits the comfort fan 100 at the gap between the top edge 324 and upper lip 322 generally in the horizontal direction and indicted by arrow 402. Posts 323 can be used to maintain separation between the conic director 318 and the inner surface 325 of the upper housing section 312. The posts 323 can be positioned away from the opening between the upper lip 322 and top edge 324 so as to conceal them from view. Air is drawn in through the inlet section 304 as indicated by arrows 406. A circular circuit board 404 can surround inlet volume, and hold light elements such as light emitting diodes 408. Light emitted from these LEDs 408 will illuminate the interior volume of the comfort fan, and light will be emitted out of the inlet 304 as well as the outlet between the upper edge 324 and upper lip 322.

Figure 5:
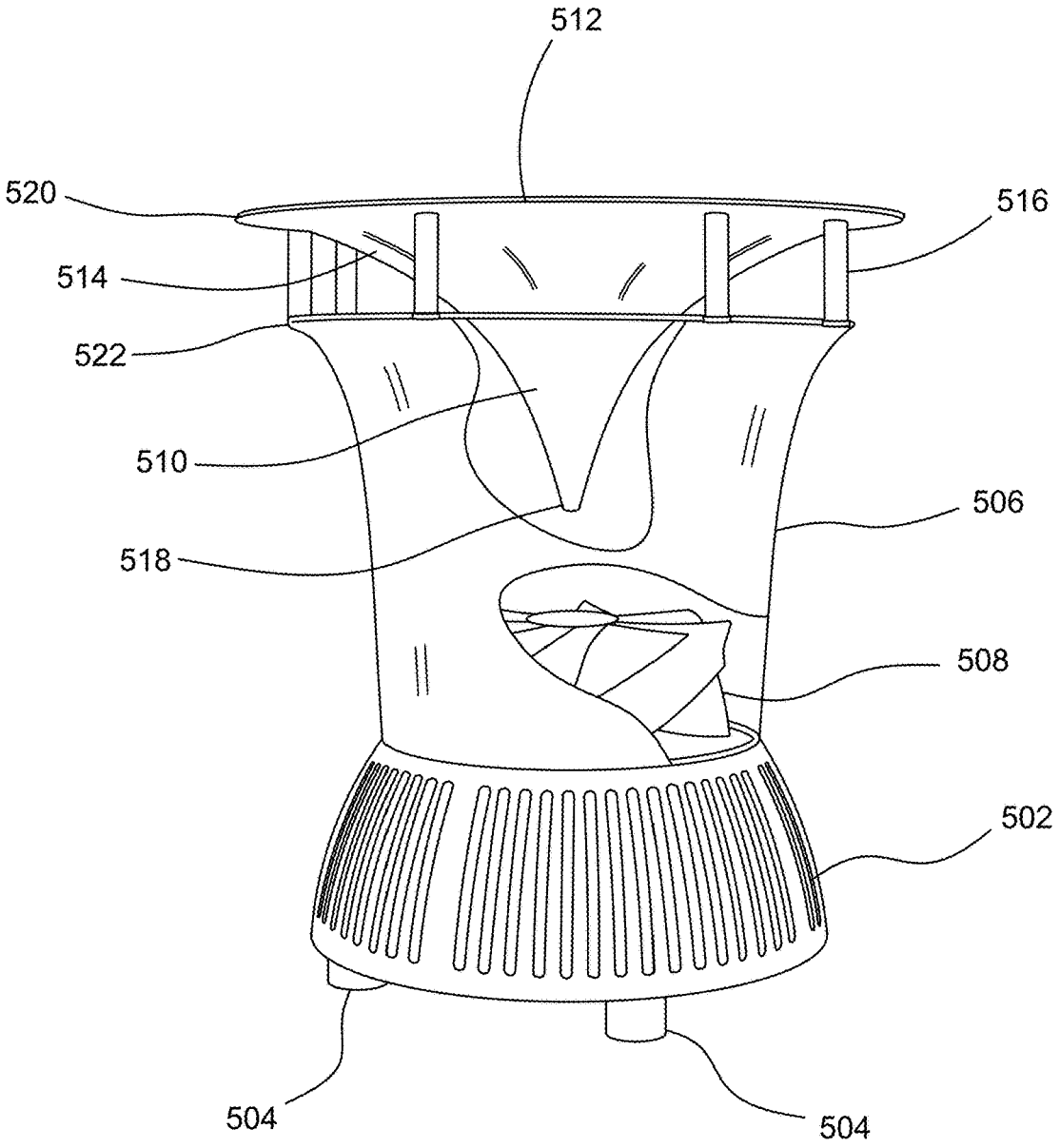
FIG. 5 shows a side perspective view of a comfort fan that provides a continuous radial air flow showing an alternative arrangement of internal components, in accordance with some embodiments.

FIG. 5 shows a side perspective view of a comfort fan 500 that provides a continuous radial air flow showing an alternative arrangement of internal components, in accordance with some embodiments. The inlet section 502 sit directly on several feet 504. The upper housing section 506 sits on the top of the inlet section 502, and can be transparent. Fan blades 508 are positioned at the bottom or lower end of the upper housing section 506. A conic director 510 is positioned above the fan blades 508 with the tip 518 of the conic director 510 centered over the fan blades 508. Air is blown by the fan blades 508 upwards, and the air is redirected by the conic director 510 outward in a generally horizontal direction, radially around he fan 500. The air blown by the fan blades 508 escapes out of an outlet formed by the gap between the outer edge 520 of the top 512 of the conic director 510, which has a hyperboloid shape, and as a result, the profile of the surface 514 of the conic director, from the tip 518 to outer edge 520 is concave. The outer edge 520 of the top 512 of the conic director 510 extends outward farther than the top lip 522 of the upper housing section 506. As a result, air is forced out between the conic director 510 and the upper lip 522 of the upper housing section 506. The further help direct the air outward in the horizontal direction, the upper portion of the upper housing section 506 can also have a hyperboloid shape which complements that of the conic director 510. Several standoffs 516 can be used to connect the conic director 510 to the top of the upper housing section 506. The standoffs 516 can be cylindrical, having a common length, and with a threaded bore at each end to receive a screw that passes through the upper lip 522 or the outer edge 520, with each standoff 516 holding a screw through both the conic director 510 at the outer edge 520 and the upper housing section 506 at the upper lip 522. Thus, air is drawn in through the inlet 502, moved by the fan blades 508 toward the conic director 510, and exits the fan 500 radially in a circular pattern in the horizontal direction. The speed of the fan blades 508 can be adjusted such that the air flow rate incident on a user or other persons around the fan is at a desired comfort level.

Figure 6:
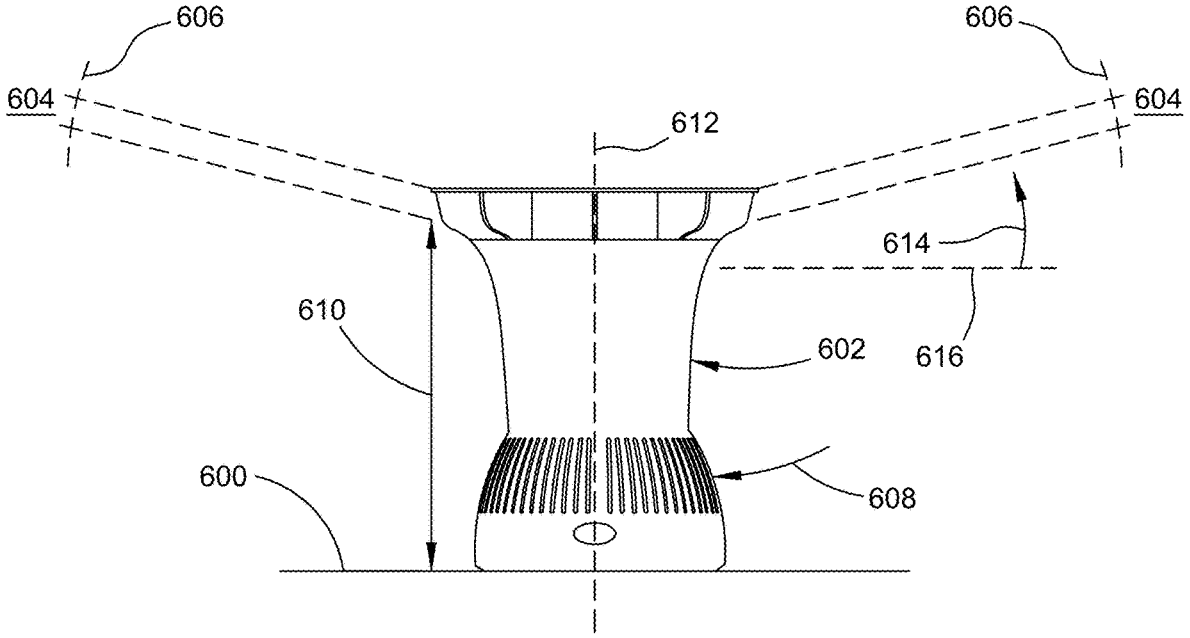
FIG. 6 shows a side profile view of a comfort fan that provides a continuous radial air flow, particularly showing the outward air flow and the elevation of the air outward air flow over a surface on which the comfort fan is located, in accordance with some embodiments.

FIG. 6 shows a side profile view of a comfort fan 602 that provides a continuous radial air flow, particularly showing the outward air flow and the elevation of the air outward air flow over a surface 600 on which the comfort fan 602 is located, in accordance with some embodiments. The surface 600 can be, for example, a table such as those commonly found in outdoor environments for dining or other leisure activity. The comfort fan 602 in the present example can be consistent with any of the exemplary embodiments disclosed herein, and those consistent with the exemplary embodiments disclosed herein.

In general, the comfort fan 602 is sized to sit on a surface, such as a table, that can be surrounded by several people (seated). For example, the surface 600 can be a circular patio or other outdoor-type table. Furthermore, the outlet of the comfort fan has a height 610 above the surface 600 such that the air is blown outward, in a radial horizontal circular pattern perpendicular to the central vertical axis 612, or at a slight angle 614 to horizontal 616, and is such that the air flow is not substantially incident on items on the surface 600. The height 610 can be, in some embodiments, eight to fifteen inches. In other embodiments the height 610 can be more than fifteen inches or less than eight inches, as the particular application may require. Elevating the outlet of the comfort fan 602 over the surface 600 prevents the air flow from the comfort fan 602 from, for example, cooling hot food, blowing napkins or other items on the surface 600, and so on. Rather, the air outflow is directed towards the people around the comfort fan 602, whose torsos, head, and faces will be substantially elevated relative to the surface 600. The angle 614 can be in the range of five to fifteen degrees in some embodiments. In some embodiments it has been found that an angle 614 of ten degrees is optimum for an ordinary circular table sized to seat four to six people. In other embodiments an angle larger than fifteen degrees or less than five degrees can be used, depending on the particular application. Generally, since the outlet of the comfort fan 602 will generally be at height that is lower than the chest/neck/face areas of persons seated around comfort fan 602, a slight upward direction will ensure that the air flow is incident on the chest/neck/face areas of the people.

Air is drawn into the fan through an inlet or inlet section 608, and is blown outward, radially in a circular pattern, horizontally as indicated by air flows 604. The speed of the air flow is adjusted so that, at some distance 606 from the fan, which is where a person or persons are likely to be positioned relative to the comfort fan 602, the air flow provides a desired cooling effect and thermal comfort. For example, it has been found that an air flow rate of about two hundred to four hundred feet per minute, over a region that generally spans from the chest to the top of a person's head, and adjustable to a speed in that range (or further outside of that range), will provide a desired thermal comfort effect. However, controls on the comfort fan 602 will allow people to adjust the air flow to a preferred air flow rate if the initial air flow rate, calculated based on temperature, and humidity conditions in some cases, is not preferable. That it, the initial air flow rate will depend on factors such as personal preference, activity level, humidity, operative (dry bulb and mean radiant) temperature, and clothing worn by the people around the comfort fan 602. The flow rate can be measured at a generally standard distance from the center of a table configured to seat four to six peoples, for example. In some embodiments, the comfort fan 602 can include a temperature sensor and a humidity sensor to sense the ambient conditions, and based on an average of how far away from the comfort fan 602 people will be assumed to be positioned, and the ambient conditions, the comfort fan can select an initial fan blade speed to hopefully provide a desired comfort effect to the people actually around the comfort fan 602. However, as individual preferences can vary, and assumptions may not always be precisely correct, the comfort fan 602 also includes controls to adjust the fan blade speed and the air flow rate. Under a set of given conditions, the person or people around the comfort fan may desire more or less air flow, and adjust the flow rate from the initial air flow rate to one that is more preferable.

Figure 14:
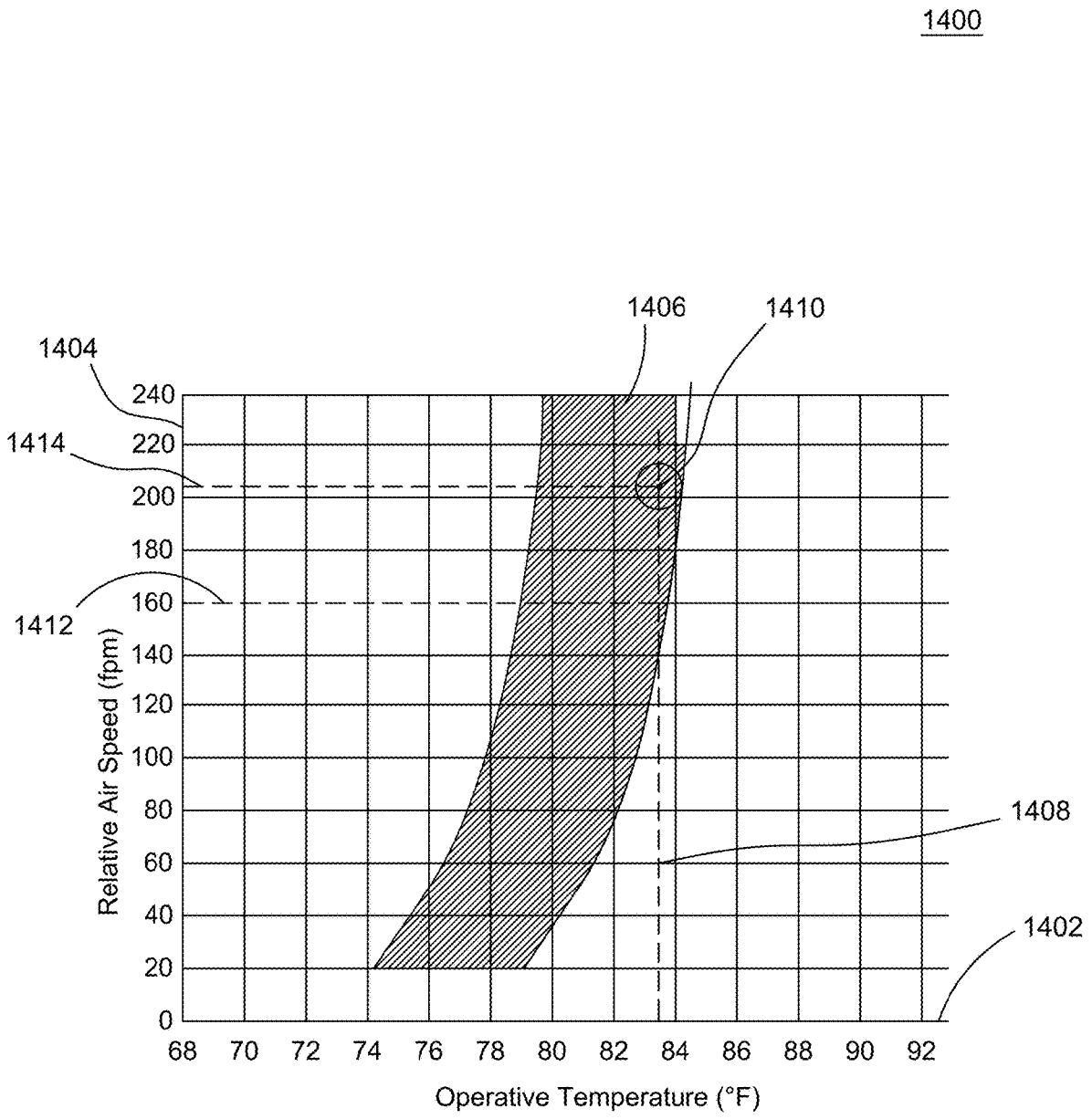
FIG. 14 shows a graph chart plotting air speed of a fan versus ambient temperature, indicating a zone of comfort in which the air speed incident on a person is sufficient to produce a desirable cooling effect.

As is well known, the incident flow rate of ambient temperature air can have a perceived cooling effect. It is also known that, at a certain flow rate and above, a person can perceive the air flow rate to be a nuisance by, for example, blowing the person's hair or even clothing excessively. Thus, the air flow rate that is incident on a person should be within a range that is perceived as having a desirable cooling effect, but not so high that it becomes an annoyance. Although, being adjustable, it is contemplated that a given person may preferable a flow rate that would be considered insufficient, or a nuisance rate by other people. The effect of moving air under different environmental conditions has been studied in great detail. The American Society of Heating, Refrigerating and Air-Conditioning Engineers (ASHRAE), for example, have produced their Standard 55-2023, titled Thermal Environmental Conditions for Human Occupancy, which describes how environmental factors (temperature, thermal radiation, humidity, and air speed) and personal factors (activity and clothing) combine in complex ways to create thermal conditions, and how personal comfort levels vary from one occupant to another. The Standard is designed to specify those combinations of factors that result in satisfactory thermal conditions for a majority of occupants. FIG. 14 discusses this standard and the tool developed by the Center for the Built Environment to identify air flow rates based on environmental factors in the discussion below.

Figure 7:
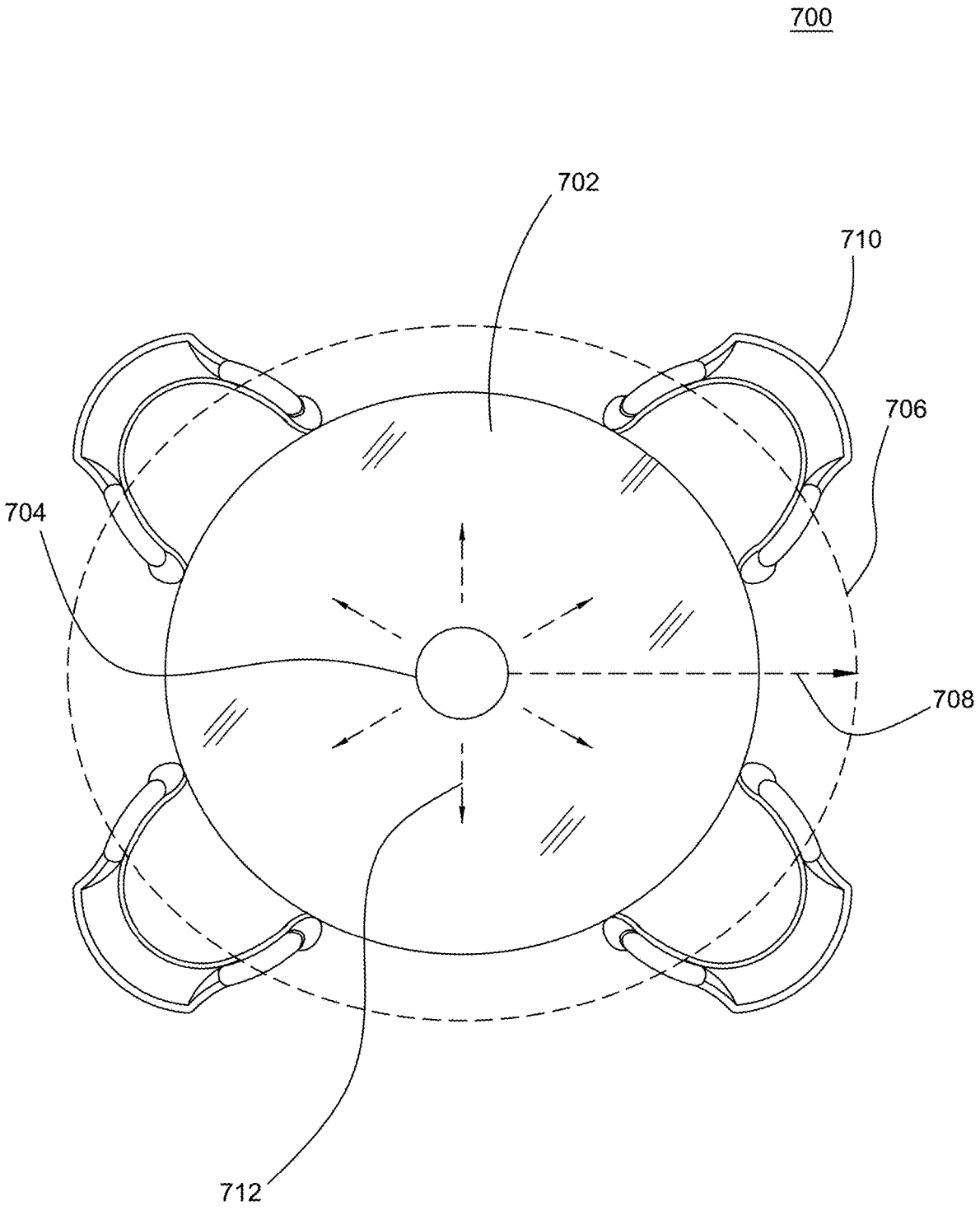
FIG. 7 shows a top plan view of a use application of a comfort fan that provides a continuous radial air flow with the comfort fan placed in the middle of a round table, in accordance with some embodiments.

FIG. 7 shows a top plan view of a use application of a comfort fan 704 that provides a continuous radial air flow with the comfort fan 704 placed in the middle of a round table 702, in accordance with some embodiments. The comfort fan 702 in the present example can be consistent with any of the exemplary embodiments of comfort fans disclosed herein, and those consistent with the exemplary embodiments disclosed herein. The comfort fan 704 is placed at the center of the table 702. Around the table 702 are several chairs 710 in which people can sit. Since the table 702 is circular, each of the chairs 710 are about the same distance from the center of the table. A dashed circle 706 represents a radial distance 708 from the comfort fan 704 at which people will be seated, on average, given the diameter of the table 702, and assuming the comfort fan 704 is placed in the center of the table 702. The radial distance 708 can be a selected distance, either as an assumption for common tables, or as an input provided by a user of the comfort fan 704. Air is blown radially, in a continuous manner, from the comfort fan, as indicated by arrows 710. The initial flow rate of the air can be based on ambient conditions (e.g. operative temperature and humidity), and the radial distance 708 at which people are generally seated from the comfort fan 704. The initial air flow rate is generated by the initial fan speed, which can be a selected speed based on the environmental factors, the relationship between fan speed and air velocity at the outlet of the comfort fan, and the selected distance. The comfort fan 704 can also include manual controls that, among other operations, allow a person to adjust the fan blade speed so that the incident air flow rate at the positions where people are seated around the comfort fan 704 is at a preferred rate.

In some embodiments, the comfort fan 704 can include a wireless radio transceiver, such as a transceiver designed in accordance with the BLUETOOTH wireless networking protocol, which allows the comfort fan 704 to wirelessly connect to, for example, a smartphone device that is running an application program designed to allow a person to control the comfort fan 704 via the smartphone device. The smartphone device, by executing the application program, can receive input regarding the air flow rate (e.g. to increase or decrease the air flow rate). Other input can be received as well, such as activating a heating element in the comfort fan to provide warm air. Furthermore, it is contemplated that the comfort fan 704 can also include lighting elements to provide light of various colors, including changing color over time, as well as light that can enable persons around the comfort fan 704 to read and see materials placed on the table 702 when the ambient lighting is dark. The comfort fan 704 generates a radial airflow around the circumference of the comfort fan 704, continuously around the entire three hundred sixty-degree circumference of the comfort fan 704. In addition to radial air flow, as indicated by arrows 712, light can be provided by the comfort fan 704 similarly, outward from the comfort fan 704 radially.

Figure 8:
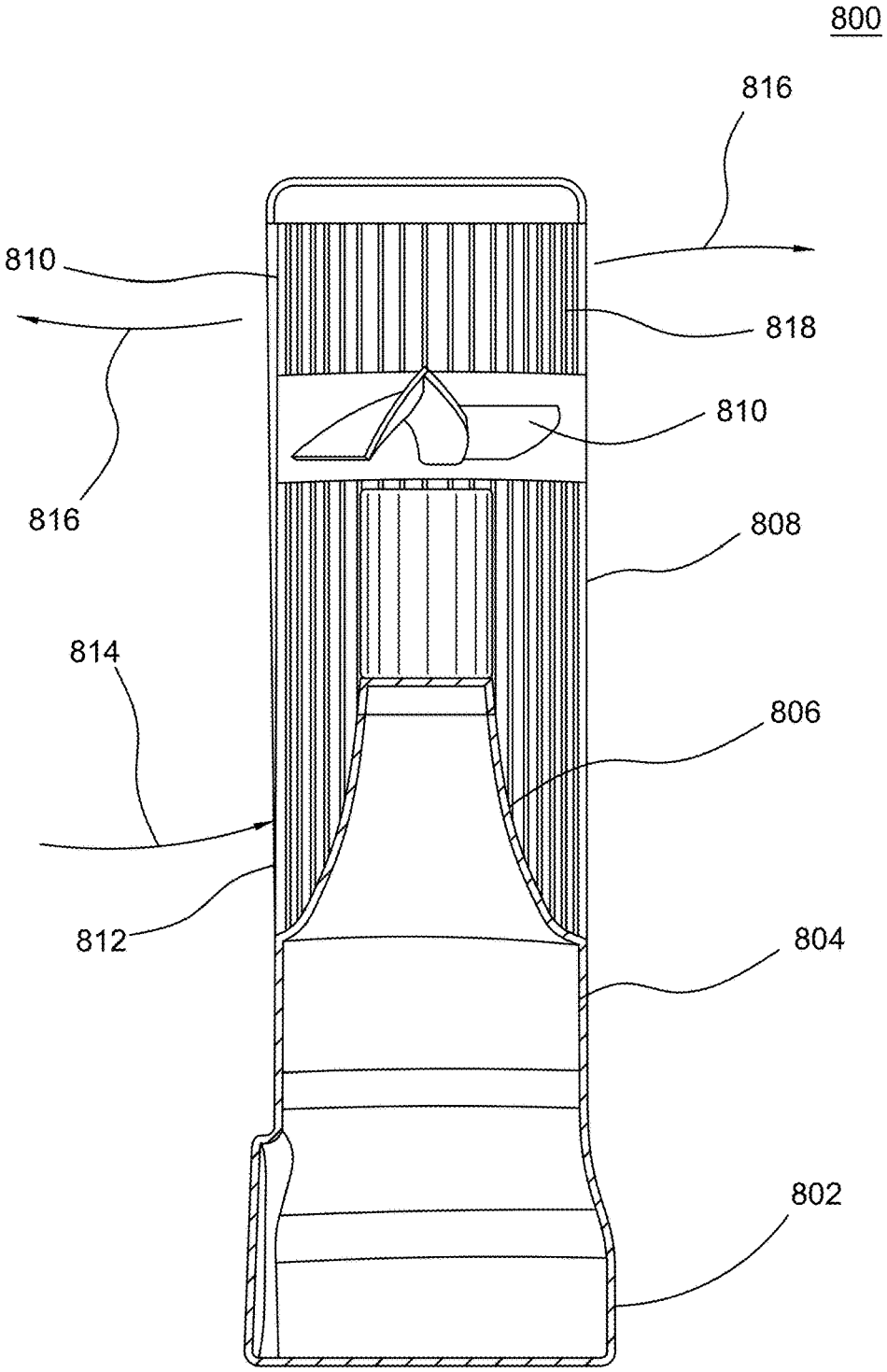
FIG. 8 shows an alternative configuration of a comfort fan that provides a continuous radial air flow, in accordance with some embodiments.

FIG. 8 shows an alternative configuration of a comfort fan 800 that provides a continuous radial air flow, in accordance with some embodiments. The comfort fan 800 can be useful in situations where the people around the comfort fan 800 are seated substantially closer to the comfort fan 800 than in the examples of FIGS. 6-7. The comfort fan 800 is shown here partially in cut-away to expose some of the internal components. The comfort fan 800 includes a base 802 which can house control components, and/or a battery or electrical connector, or both. A conic director 806 is inverted relative to the conic directors shown in embodiments discussed previously, and includes an attachment section 804 that can connect with the base 802. A middle housing section 808 can provide an outlet through a plurality of slots. Air blown by the fan blades 810 is drawn in through in inlet 812, as indicated by arrow 814 and drawn over the conic director 806 (which has a hyperboloid shape), and out of the outlet 818, as indicated by arrow 816. The comfort fan 800 can be used in more intimate settings, where, for example, a smaller fan can be used compared to that of a larger table used, for example, for dining. Overall, the comfort fan 800 has a cylindrical shape with a circular horizontal cross section. The air outlet 818 is configured to direct air outward, horizontally and radially in all directions to provide continuous air flow to people gathered round the comfort fan 800. Since the comfort fan 800 does not oscillate, the air flow is simultaneously experienced at any point around the comfort fan 800. The comfort fan 800 can also include controls that can be adjusted manually, or wirelessly (e.g. via a phone application program).

Figure 9:
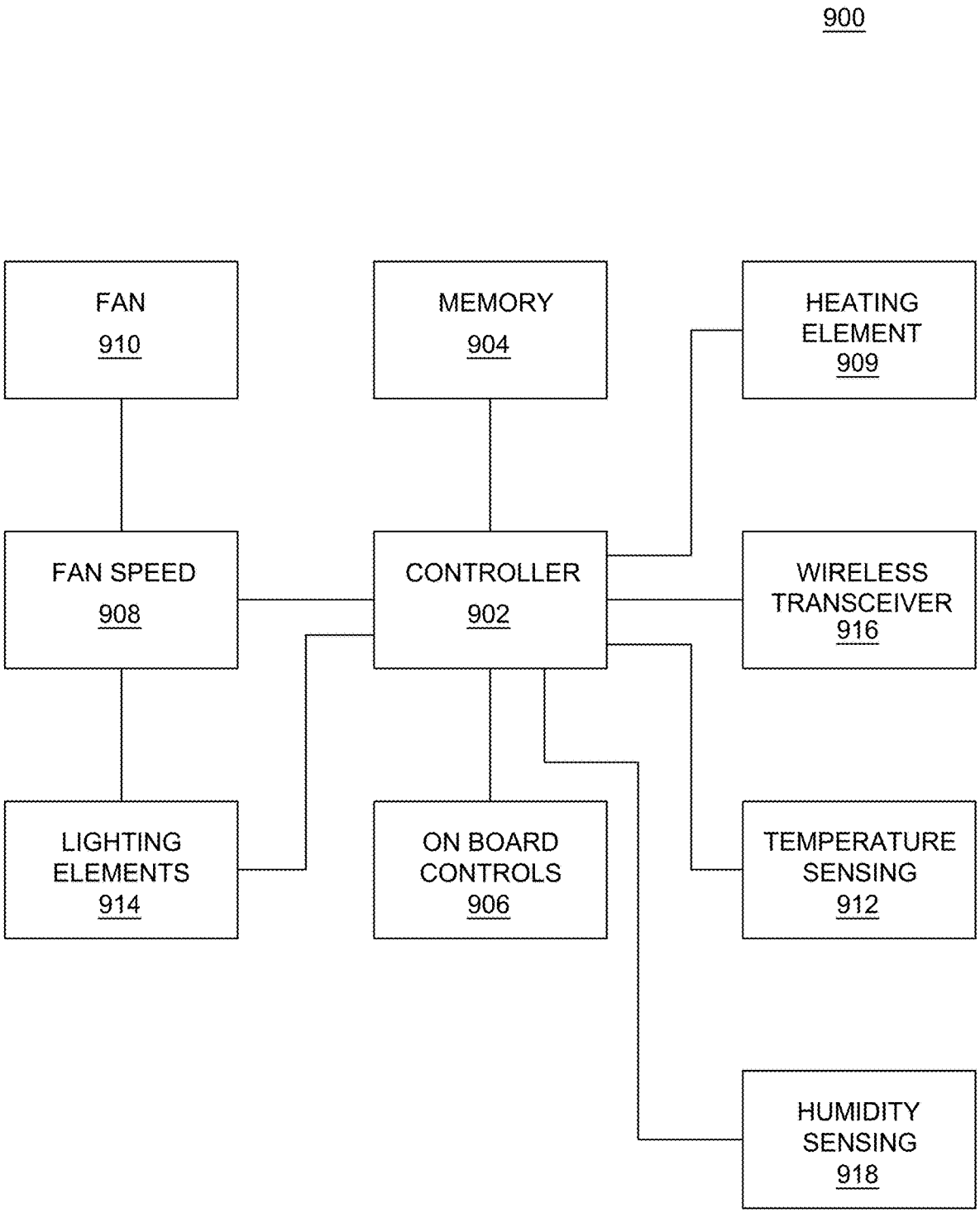
FIG. 9 shows a block schematic diagram of a comfort fan that provides a continuous radial air flow, in accordance with some embodiments.

FIG. 9 shows a block schematic diagram of a comfort fan 900 that provides a continuous radial air flow, in accordance with some embodiments. The electrical and electronic components represented herein can be consistent with any of the exemplary comfort fan embodiments disclosed herein, and those other equivalent embodiments consistent with the exemplary embodiments disclosed herein. The comfort fan 900 can include a controller 902, such as a microcontroller or microprocessor that is capable of performing instruction code that is designed to, for example, control fan speed in relation to various input, control lighting and heating elements as well, among other functions. The controller 902 can be coupled to a memory 904 which can represent an aggregate memory that includes both long term storage memory (e.g. read only memory) as well as "scratchpad" memory (e.g. random access memory). The controller 902 can further be coupled to manual controls 906 such as one or more potentiometers for adjusting various fan operations, such as fan blade speed. The resistance of the potentiometer can be sensed by a voltage divider and the voltage can be converted into a digital value by an analog to digital converter port of the controller 902. The controller 902 can further be coupled to a fan speed module 908 that controls the speed of the fan blades of fan 910. In some embodiments the comfort fan 900 can include a temperature sensor 912 that senses the ambient temperature. Further, a humidity sensor 918 can also be used in conjunction with temperature information so that an initial fan speed can be selected, which can then be adjusted, if necessary, using one of the controls 906. The temperature sensor 912 indicates the present ambient temperature, and the humidity sensor indicates the present ambient relative humidity. In some embodiments temperature alone can be used to set the initial fan speed, and in some embodiments both temperature and relative humidity are used to calculate an appropriate initial fan speed.

In some embodiments, the comfort fan 900 can also include lighting elements 914 that can be adjusted using one or more of the controls 906. For example, a color selection can be made, as well as a brightness level. In some embodiments, the light color can change over time, gradually changing from one color to another. Furthermore, in some embodiments a heating element 909 can be present to heat the air drawn into the comfort fan 900 in cases where the ambient temperature is lower than a comfort threshold so that warm air is blown out to the people around the fan 900. Finally, in some embodiments, there can be a wireless transceiver 916 that allows the fan 900 to wirelessly connect to, for example, a smartphone or similar computing device. It is contemplated that a smartphone (or equivalent) device can run an application program designed to control the comfort fan, providing both initial control as well as input for manual control of the comfort fan 900 as well. Control information can be transmitted to the wireless transceiver 916 that indicates a fan speed, or fan speed adjustment information so that a user can adjust the fan speed to a more preferable speed if the initial fan speed is not preferable.

Figure 10:
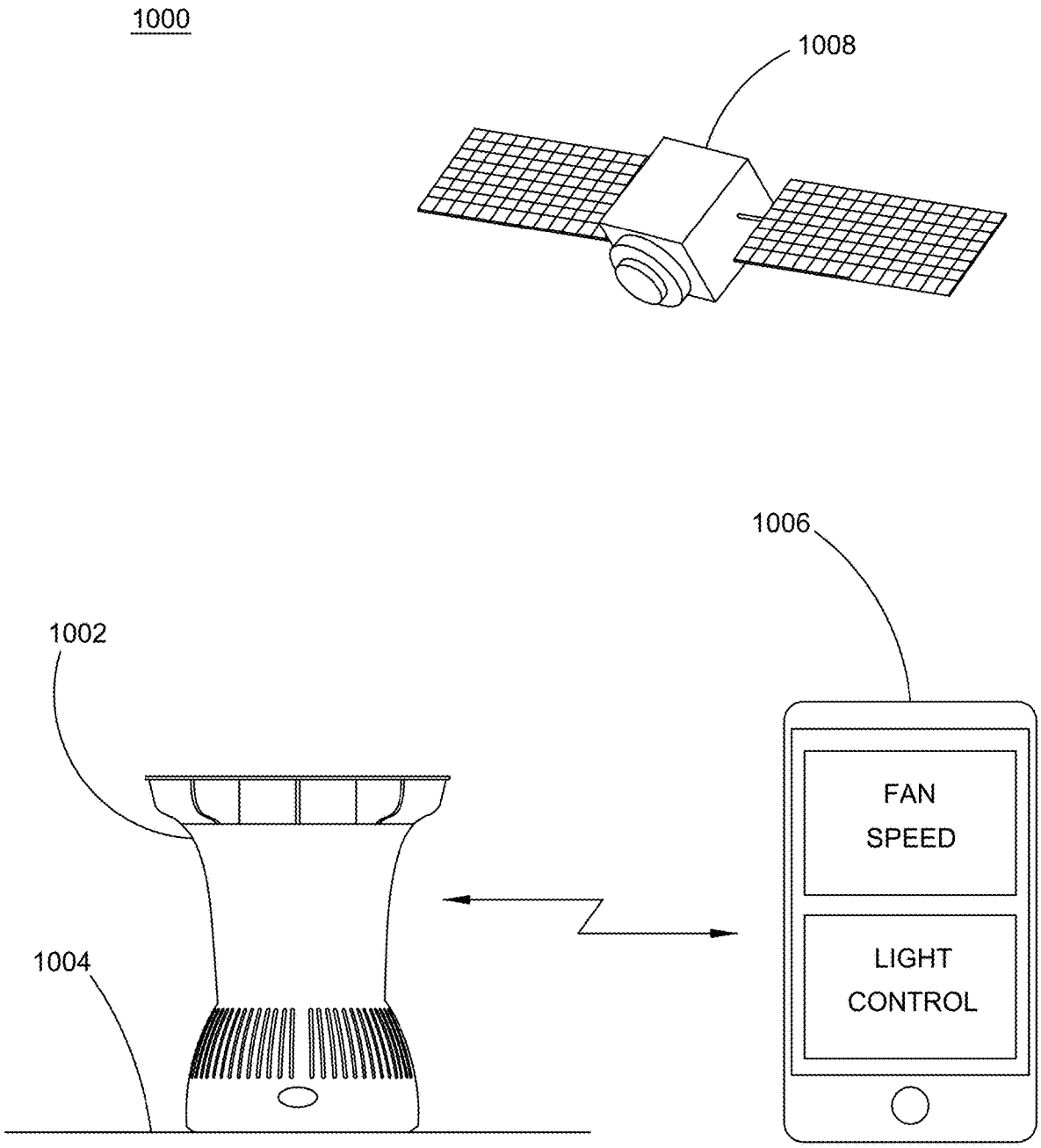
FIG. 10 shows a system diagram of a comfort fan that provides a continuous radial air flow that is operated in conjunction with a smartphone application program to automate operation of the comfort fan, in accordance with some embodiments.

FIG. 10 shows a system diagram 1000 of a comfort fan 1002 that provides a continuous radial air flow that is operated in conjunction with a smartphone application program to automate operation of the comfort fan, in accordance with some embodiments. The fan 1002 can be consistent with any of the exemplary comfort fan embodiments disclosed herein, and those other equivalent embodiments consistent with the exemplary embodiments disclosed herein. The fan 1002 can be set on a surface 1004, such as a table, counter, or other surface near people. The fan 1002 is intended to provide an air flow or either ambient air, if the ambient air temperature is warm, or heated air if the ambient air temperature is cool/cold. The fan 1002 can be wirelessly coupled to a computing device, such as a smartphone device 1006 that runs an application program designed to allow a user to control operation of the fan 1002. For example, the application program can provide graphical elements to receive input for controlling fan speed and lighting elements of the fan 1002. In some embodiments the smartphone can determine its location while connected to the fan using, for example, satellite positioning signals from overhead positioning satellites 1008. The location can then be cross referenced with a weather report for the region indicating the present temperature, which the smartphone device, via the application program, can use to set an initial fan speed that can be subsequently adjusted by the user, if so desired. In some embodiments, if the weather information indicates that the ambient temperature is cold, then the smartphone device 1006 can activate a heating element in the fan 1002 to provide warm air.

Figure 12:
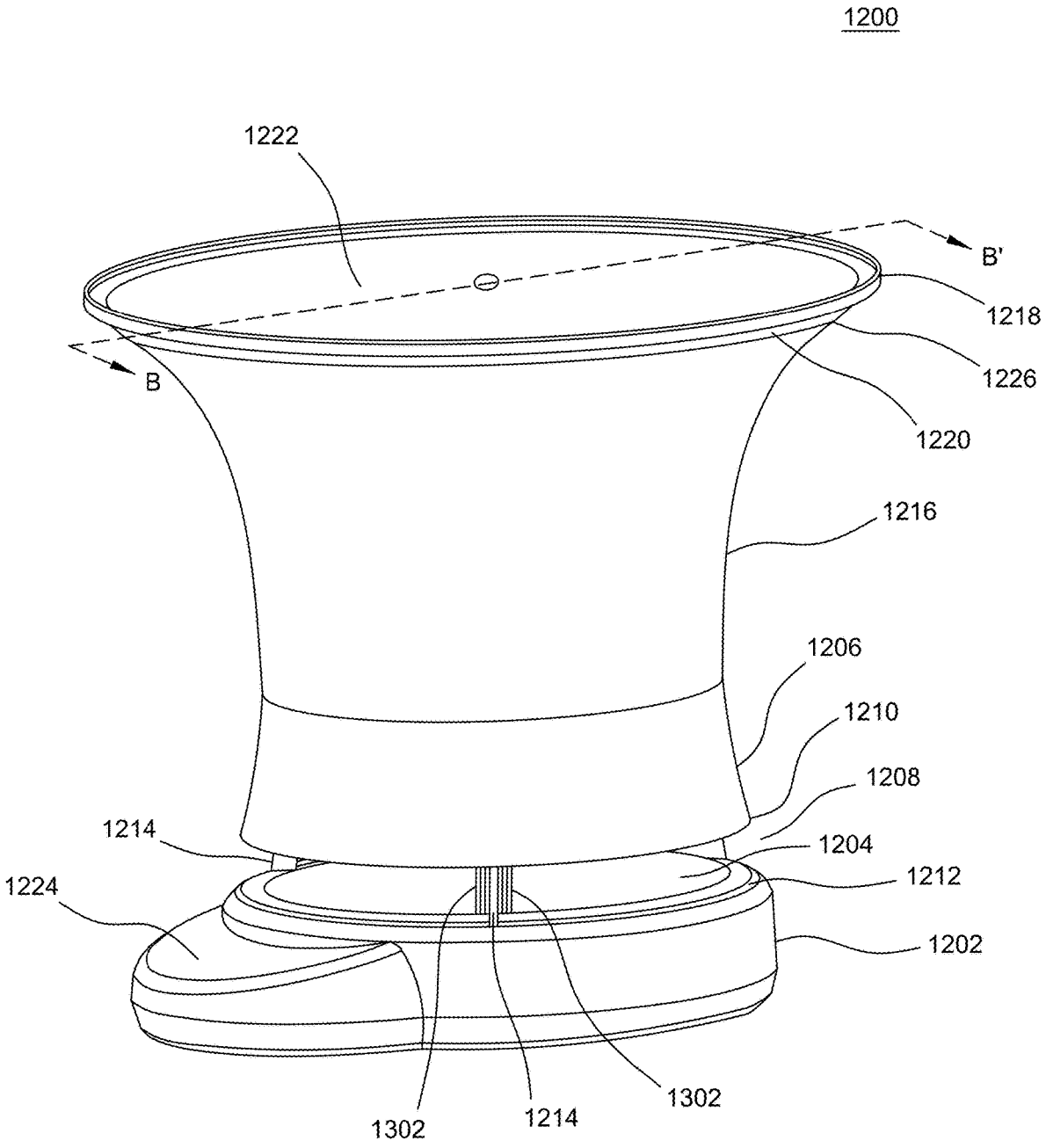
FIG. 12 shows a perspective view of a comfort fan having a hyperboloid shape, in accordance with some embodiments.
Figure 13:
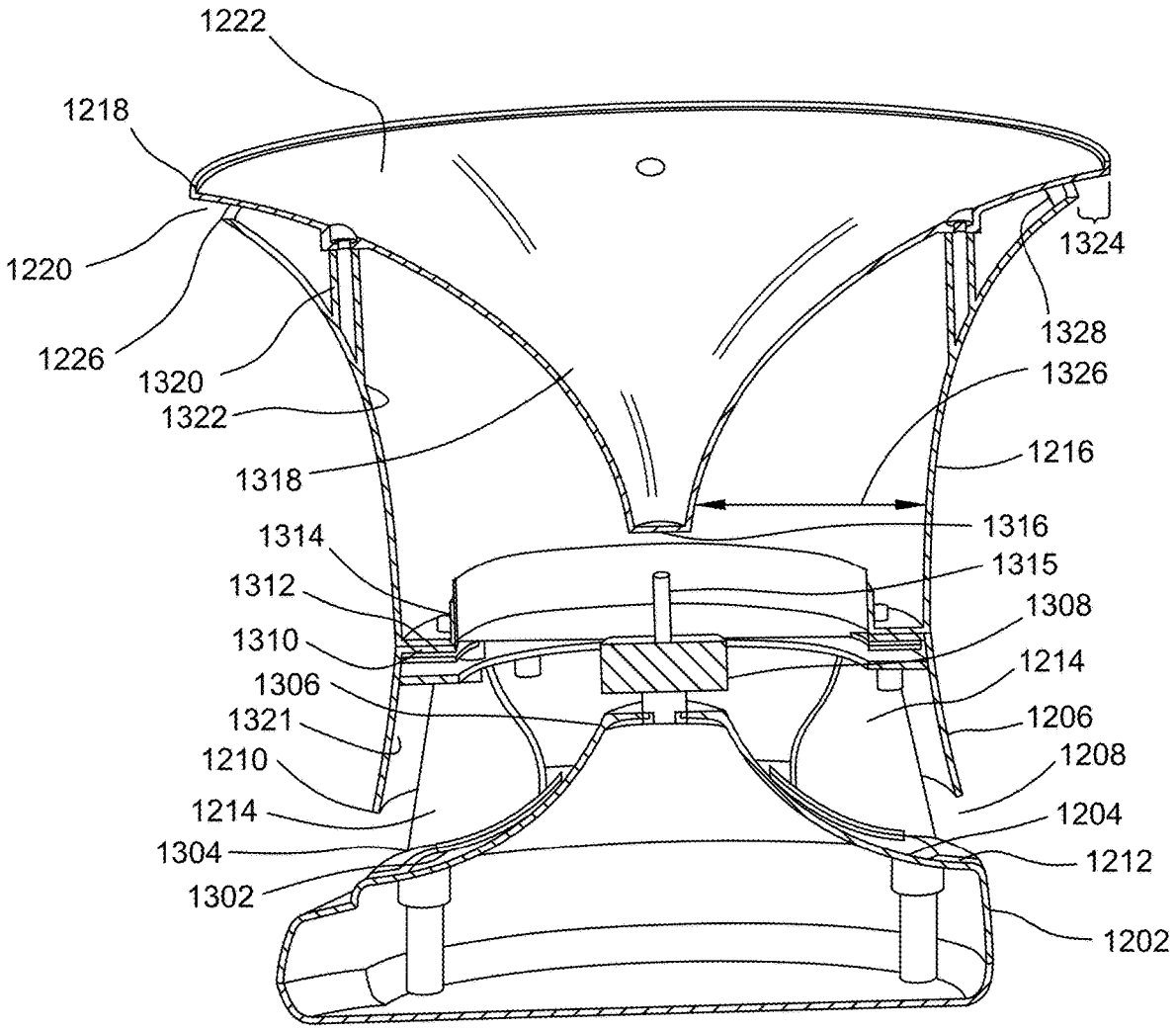
FIG. 13 shows a cross sectioned view of the comfort fan of FIG. 12, in which the major structural components are shown.

FIG. 12 shows a perspective view of a comfort fan 1200 having a hyperboloid shape, in accordance with some embodiments. In general, the comfort fan 1200 is columnar with a hyperboloid shape to the main body. FIG. 13 shows a cross sectioned view of the comfort fan, with the section being vertical along line B-B'. Reference should be made to both drawings for the following discussion. They hyperboloid shape is similar to that of the comfort fan embodiments shown in FIGS. 2-6. The comfort fan includes a base 1202 in which there can be, for example, electronic to operate the comfort fan 1200, light elements, a user interface. A battery and/or power circuitry can also be included in the base 1202. The base 1202 is generally circular when viewed from the top or bottom (i.e. in a horizontal plane), and can include a user interface section 1224 that extends outward from the base 1202, and can include user interface elements to control and operate the comfort fan 1200, including, for example, a graphic display screen and buttons.

An inlet air director 1204 sits over the base and the surface of the inlet air director 1204 has a hyperboloid shape from the outside edge 1212 up to a top 1306 of the inlet air director 1204. The hyperboloid shape of the inlet air director 1204 is such that the top 1306 is much smaller in diameter than the outer edge 1212, follows a hyperbolic curve in a direction from the outer edge 1212 to the top 1306, and the top 1306 of the inlet air director 1204 terminates just below an axial fan motor 1308. The comfort fan 1200 also includes two outer side housing portions, including a lower side housing portion 1206 and an upper side housing portion 1216. The side housing portions 1206, 1216 have an outer surface that, in the vertical direction, follows a hyperboloid curve. In particular, the bottom 1210 of the lower side housing portion 1206 extends outward farther than the top of the lower side housing portion 1206 where it meets the bottom of the upper side housing portion 1216. In some embodiments, where the side housing portions 1206, 1216 meet can be the narrowest point, in the horizontal direction, of the side housing portions 1206, 1216. Between the bottom edge 1210 of the lower side housing portion 1206 and the outer edge 1212 of the base 1202 is a circumferential gap 1208 that acts as an air inlet.

The upper side housing portion 1216 continues the hyperbolic curve outward to a top edge 1226. There is a circumferential gap 1220 between the top edge 1226 and the outer edge 1218 of the upper air director 1222. The upper air director 1222 and the lower air director 1204 are both directional ducting members as they direct air through the interior of the comfort fan, from the inlet 1208, through the fan, and out of the outlet 1220. The upper air director 1222 has a hyperboloid shape along its surface 1318, being narrowest, in the horizontal direction, at a lower tip 1316 that is positioned directly over the axial fan and centered on the axis 1315 of the axial fan. In the present embodiment, the outer or outside surface of the upper air director 1222 can follow the inner surface 1318, resulting in a hyperboloid cavity at the top of the comfort fan 1200. The upper air director 1222 can be mounted to the inner side 1322 of the upper side housing portion 1216 by several posts 1320 that extend vertically from the inner surface 1322 of the upper side housing portion to the inner surface 1318 of the upper air director 1222. The material of the upper air director 1222 can be heat staked, screwed, glued, or otherwise affixed to the post 1320 at each instance of the posts 1320.

The lower side housing portion 1206 has a top portion 1310 that turns inward, and follows the circumference of top of the lower housing portion 1206. Similarly, a bottom portion 1312 of the upper side housing portion 1216 abuts the top portion 1310, and also turns inward, thereby creating a region where the top portion 1310 can be joined or fastened to the bottom portion 1312. However, the bottom portion 1312 of the upper side housing portion 1216 forms a cowl 1314, which is a vertically oriented band around the circumference of an inside edge of the bottom portion 1312 of the upper side housing portion 1216. The cowl 1314 acts as a duct, and the fan blades of the axial fan are positioned in the cowl 1314 to create a highly efficient movement of air through the comfort fan 1200.

The lower side housing member 1206 can include three or more vertically oriented vanes 1214 that are planar in a radial direction from the central axis, which the vertically through the shaft 1315 of the axial fan. The bottoms 1304 of the each of the vanes 1214 can be captured in a respective slot formed between parallel raised runners 1302 along the surface of the lower air directors 1204. This allows the housing assembly, comprising the lower side housing portion 1206, the upper side housing portion 1216, and upper air director 1222 to be easily lifted and removed from the base 1202 and lower air director 1204. The housing assembly can be replaced by aligning the vanes 1214 with the slots formed by the parallel raised runners 1302.

In operation, when the axial fan motor 1308 is turned on, the axial fan blades (disposed within the cowl 1314, will turn in a direction that moves air from the inlet 1208, through the interior of the comfort fan 1200, and out of the air outlet 1220, with the air movement being guided by the lower air director 1204, the surface 1318 of the upper air director 1222, and hyperboloid curve of the interior surfaces 1321, 1322 of the lower and upper side housing portions 1206, 1216. Going upwards, the distance between the upper side housing portion 1216 and the upper air director 1222 decreases, and as a result, the pressure of the air moving through the air outlet 1220 is increased. For example, the distance 1326 between the surface 1318 of the upper air director 1222 and the inside if the upper housing portion 1216 is much larger than the distance 1328 near the air outlet 1220. This narrowing of the outlet, despite the larger circumference, increases the air velocity at the outlet 1220 relative to that lower inside the comfort fan. The relationship between fan speed and air velocity at the outlet 1220 can be characterized, such as by testing, and used to determine the optimum fan speed for an initial air velocity calculated based on environmental factors. The outer edge 1218 of the upper air director 1222 extends outward in the horizontal direction farther than the top edge 1226 of the upper side housing portion 1216 by a distance 1324, which is configured to direct air outward, radially (mostly in the horizontal direction), and circumferentially (i.e. in a 360° direction) around the comfort fan 1200. The velocity of the air exiting the air outlet 1220 is controlled so that, at a given distance from the comfort fan the air will be moving at a rate that falls within a comfort region for the given ambient environmental conditions. That distance can be, for example, from the center of a round table to the seating positions around the table, as described in reference to FIG. 7.

FIG. 14 shows a graph chart 1400 plotting air speed 1404, in feet per minute, incident on a person, versus ambient temperature 1402, indicating a zone 1406 of comfort in which the air speed incident on the person is sufficient to produce a desirable and substantially cooling effect. The chart 1400 was produced using the THERMAL COMFORT TOOL of the Center for the Built Environment, which implements Specification Standard 55-2023 of the ASHRAE, as provided at https://comfort.cbe.berkely.edu. The parameters used to generate the chart 1400 were selected to be similar to those of Miami, Florida. The operative temperature was set to 83.6 degrees F., and the relative humidity was set to 84.9%. An air speed of 200 feet per minute (fpm) is represented at location 1410 in the zone 1406. Beyond 79 degrees F. the necessary air speed increases sharply, and at 83.6 degrees F. a minimum air speed of 160 fpm is needed at the individual's exposed skin to provide a sufficient cooling effect. In the present example a cooling effect of 5.3 degrees F. is achieved. The air speed of 200 fpm is measured at the individual. To generate that air speed at the individual, the comfort fan must output air at a greater speed since it is a given distance (e.g. distance 708 in FIG. 7) from the individual. However, the calculation of output air speed from the comfort fan to achieve the desired air speed at the given distance from the fan is known, and can be programed into the comfort fan so that the controller (e.g. 902) can control the fan speed to output air at a speed that achieves the desired thermal comfort effect at the given distance from the comfort fan.

The inventive comfort fan as disclosed herein avoids the problems associated with prior art fans, such as oscillating fans, that only intermittently provide air flow across a wide angle. The inventive comfort fan uses a radial ducting system to direct airflow outward from the comfort fan around a wide angle, if not completely around the comfort fan, continuously so that at any point within the radial field equidistant from the comfort fan the same flow rate of air will be experienced as a continuous flow. The comfort fan draws in air at, or near its base, and directs the air, by fan blades, to a conic director, such as a circular hyperboloid air duct, which distributes the air flow evenly outward in a circle around the comfort fan, or at least around a large angle (e.g. one hundred twenty degrees or more) that is not achievable with conventional fans.

The claims appended hereto are meant to cover all modifications and changes within the scope and spirit of the present invention.

What is claimed is:

1. A fan device, comprising:

a housing having a columnar shape and defining a central vertical axis, the housing having a base that is configured to sit on a surface, and a top having a top edge that extends circumferentially around the central vertical axis;

an inlet configured to allow air into the housing at a side of the housing above the base;

a fan positioned inside the housing between the inlet and an outlet at the top of the housing, and configured to blow air toward the outlet;

a motor coupled to the fan and positioned below the fan; and a directional ducting member positioned inside the housing between the fan and the outlet, wherein the directional ducting member has a lower terminus positioned over a center of the fan, and a top of the directional ducting member has an outer edge that extends circumferentially around the vertical axis and that is positioned over the top edge of the housing to form the outlet as a gap between the outer edge of the top of the directional ducting member and the top edge of the housing to direct air blown by the fan outward radially and circumferentially from the outlet, and the outer edge of the top of the directional ducting member extends outward radially from the central vertical axis at least as far as the top of the housing, and wherein a distance between an inside of the housing and the directional ducting member decreases between the lower terminus and the housing, in a horizontal direction, and between the top edge of the housing and the directional ducting member, in a vertical direction, the outlet, wherein the lower terminus of the directional ducting member is within the housing and below the top edge of the housing, and is positioned centrally over the fan.

2. The fan device of claim 1, wherein the outlet is positioned at a top of the comfort fan.

3. The fan device of claim 1, wherein the outlet is configured to direct air at an angle of between five and fifteen degrees upward relative to horizontal.

4. The fan device of claim 1, wherein the fan is oriented to blow air in a vertical direction.

5. The fan device of claim 1, further comprising a control which is operable to adjust an air flow rate by controlling a speed of the fan.

6. The fan device of claim 5, wherein the control includes a manual control provided on the fan device.

7. The fan device of claim 5, wherein the control further includes a wireless transceiver operable to receive control information that indicates a speed of the fan to control the air flow rate.

8. The fan device of claim 1, further comprising a temperature sensor, wherein an ambient temperature indicated by the temperature sensor is used, at least in part, by the fan device to set an initial air flow rate out of the outlet.

9. The fan device of claim 8, further comprising a humidity sensor, and wherein an ambient relative humidity indicated by the humidity sensor is further used by the fan device to set an initial air flow rate out of the outlet.

10. The fan device of claim 1, further including a light element that can be selectively illuminated to provide light outward from the fan device.

11. A comfort fan, comprising:

a housing having a vertical axis and top having a top edge, and partially defining an air inlet at a bottom of the housing;

a base on which the housing is mounted, the base configured to sit on a surface, the air inlet being a gap between the base and the bottom of the housing;

a fan having fan blades positioned inside the housing between the air inlet and the top of the housing;

a motor coupled to the fan blades to drive the fan blades at a selected speed of a variable speed range of the motor; and a directional ducting member inside the housing positioned over the fan blades, the directional ducting member having a top having an outer edge that is positioned over the top of the housing and which extends outward from the vertical axis at least as far as the top of the housing to define a circumferential air outlet as a gap between the top edge of the housing and the outer edge of the top of the directional ducting member, wherein the air outlet is configured to direct air blown by the fan blades through the air outlet radially outward perpendicular to the vertical axis, wherein a distance between the directional ducting member and the housing decreases from a lower terminus of the directional ducting member, in a horizontal direction, to the top edge of the housing and the directional ducting member at the air outlet, in a vertical direction.

12. The comfort fan of claim 11, wherein the air outlet is positioned at a height of eight to fifteen inches above a bottom of the comfort fan.

13. The comfort fan of claim 11, wherein the motor is operable to provide an air flow rate that can be varied by the motor from 160 to 400 feet minute at a selected distance from the comfort fan.

14. The comfort fan of claim 11, further comprising a temperature sensor, wherein an ambient temperature indicated by the temperature sensor is used, at least in part, to set an initial air flow rate out of the air outlet.

15. The comfort fan of claim 14, further comprising a humidity sensor, and wherein an ambient relative humidity indicated by the humidity sensor is further used by the comfort fan to set an initial air flow rate out of the outlet.

16. The comfort fan of claim 11, further including a light element that can be selectively illuminated to provide light outward from the comfort fan.

* * * * *